US005636869A

United States Patent [19]

Holmes

[11] Patent Number: 5,636,869

[45] Date of Patent: Jun. 10, 1997

[54] HINGE CLIP, DISPLAY BOOK, AND METHOD FOR DISPLAYING SAMPLES IN A BOOK

[75] Inventor: Colby Holmes, Ft. Wayne, Ind.

[73] Assignee: Colwell Industries, Inc., Minneapolis, Minn.

[21] Appl. No.: 325,783

[22] Filed: Oct. 19, 1994

[51] Int. Cl.[6] ..... B42F 13/00

[52] U.S. Cl. ..... 281/45; 281/47; 281/21.1; 281/28; 402/73

[58] Field of Search ..... 281/21.1, 28, 46, 281/47, 48, 45; 402/70, 73, 79, 80 R

[56] References Cited

U.S. PATENT DOCUMENTS 4,180,341 12/1979 Langhorst .
4,521,035 6/1985 Berezowsky .
4,557,503 12/1985 Linn ..... 281/47
4,623,169 11/1986 Hutten ..... 281/48 X
4,934,738 6/1990 Colonna ..... 281/21.1 X
4,949,997 8/1990 Champagne .
5,031,936 7/1991 Vannier .
5,104,147 4/1992 King .

*Primary Examiner*—Willmon Fridie, Jr.
*Attorney, Agent, or Firm*—Merchant, Gould, Smith, Edell, Welter & Schmidt

[57] ABSTRACT

A hinge clip for a display book for holding display samples for consumers to review includes a clip mounted along a clamp. The clamp is capable of securing a board which forms a page of the display book, and the clip is capable of releasably holding samples in the display book. Several hinge clips can be hingedly connected together.

12 Claims, 4 Drawing Sheets

HINGE CLIP, DISPLAY BOOK, AND METHOD FOR DISPLAYING SAMPLES IN A BOOK

FIELD OF THE INVENTION

The present invention relates to a hinge clip for use in a display book holding display samples such as textile fabrics including upholstery and carpet, leather, wall paper, window covering, wood veneer, paint or stain chips and the like; a display book for holding display samples; and a method for displaying samples in a book.

BACKGROUND OF THE INVENTION

Display books for holding samples of textile fabrics, wallpaper, or other materials are used for consumers to review prior to selecting a material to cover furniture, floors, walls, windows, etc. Typically, such display books must be capable of holding hundreds of samples.

A page of a prior art display book for displaying textile fabrics is shown in FIG. 1. Page 10 is combined with several other identically constructed pages to provide a book containing hundreds of textile samples from which to select. The assembly shown has board 11 which serves as the backbone of page 10. Along an edge of board 11 is a clamp 12 having dual hinges 13 which can be combined with similarly arranged hinges on other pages to provide a book binder. Along an adjacent upper edge of page 10, a clip 14 is adhered to board 11. Clip 14 holds textile samples 15.

The time required to prepare a display book from the above-described prior art page is considerable because of the several steps required to assemble its multiple parts. In particular, clip 14 must be adhered to board 11 using an adhesive. Since the adhesive must cure before the textile samples can be inserted therein, the assembly process is slowed by the time required for the adhesive to set. Accordingly, it would be desirable to prepare a display book from fewer parts and, in particular, to avoid the use of adhesives.

A display book prepared from the above-described prior art page can be awkward to use since the free ends of the textile samples (opposite the clipped end) tend to fall toward the book binder as the pages are turned when the book is laying down. In order to keep the samples in place on the board, strips of clear plastic overlay 17 extend from the clip over the samples and are secured by VELCRO patches 16. These strips of clear plastic overlay make it difficult to flip through the textile samples. Accordingly, it would be desirable to provide a display book which is easier to use and does not need plastic overlay and VELCRO patches to hold the samples to the board.

SUMMARY OF THE INVENTION

A hinge clip for holding display samples is provided by the present invention. The hinge clip has a clamp having a first arm and a second arm, each arm having an inside surface and an outside surface; a clip positioned along a length of the outside surface of the first arm of the clamp; and a binder along the clamp for hingedly connecting the hinge clip. The clamp is capable of securing a board therein for forming a page in a display book. The first arm of the clamp has a gripping member which allows it to secure a board between the first arm and the second arm. The clip is capable of releasably holding display samples such as textile fabrics including upholstery and carpet, leather, window covering, wood veneer, paint or stain chips, and the like. By releasably holding display samples, it is possible to insert the display samples between the clip and the first arm of the clamp by hand and remove the display samples therefrom by hand. It is additionally desirable that the display samples are held in place sufficiently to resist being removed by forces caused by, for example, gravity and casual handling thereof.

In a preferred embodiment, a second clip is positioned along a length of the outside surface of the second arm of the clamp. Similar to the clip described above which can be referred to as the first clip, this second clip is capable of releasably holding display samples against the outside surface of the first arm of the clamp.

The binder can be any type of fastener which is capable of providing a connection enabling two hinge clips to be hingedly connected and thereby rotate about an axis relative to each other. Accordingly, two or more hingedly connected binders can form the binding of a book. Preferably, the binder constitutes dual axially aligned staggered tubes which can form a hinge when combined with a corresponding axially aligned staggered tubes and an axis pin.

The hinge clip can be a continuous extruded plastic or polymer composition. Any type of plastic material which can be extruded and provide sufficient structural support can be used for preparing the hinge clip. A preferred plastic material is polyvinyl chloride. In addition, the hinge clip can be assembled from separate clamp and clip components which may be individually prepared from plastic and/or metal.

A display book for holding display samples is provided by the present invention. The display book contains at least two interconnected hinge clips described above. Preferably, the hinge clips are interconnected via dual interlocking tube members located on a backside of the clamp, and includes an axis pin hingedly connecting the tube members. The axis pin extends through the axially aligned tubes to provide an axis around which the hinge clips can rotate.

A method of displaying samples in a book is provided by the present invention. The method involves inserting at least one board into the clamp and inserting at least one display sample between the clip and the outside surface of the first arm of the hinge.

DETAILED DESCRIPTION OF THE INVENTION

Figure 1:
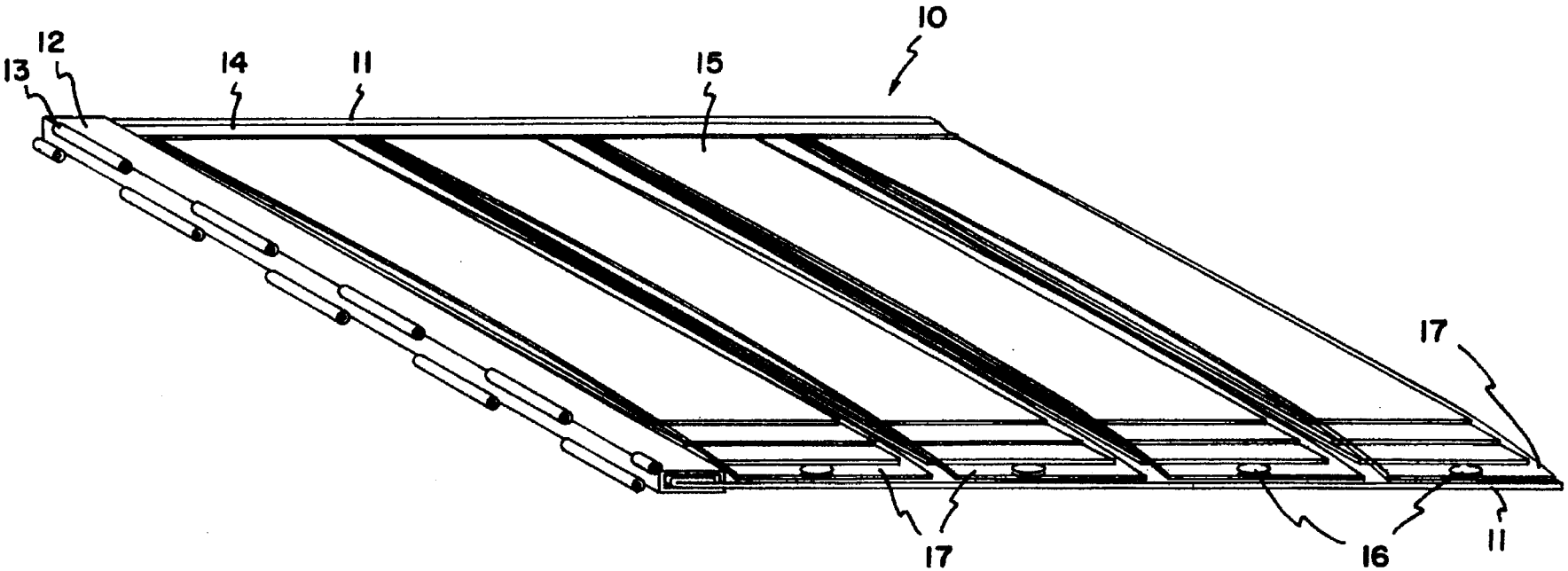
FIG. 1 PRIOR ART
FIG. 1 is a perspective view of a page of a prior art display book having samples engaged therein.

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

Figure 3:
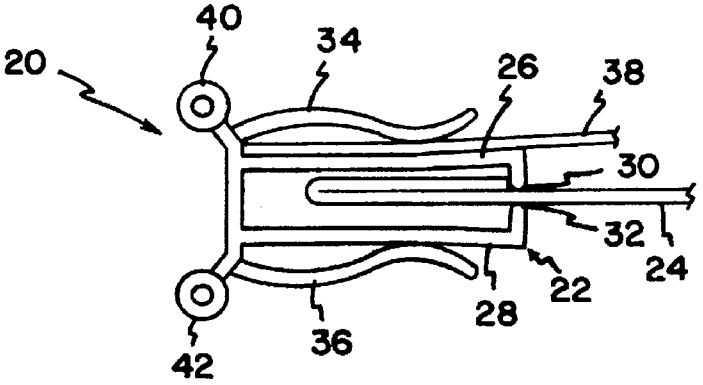
FIG. 3 is a sectional view of the hinge clip containing a page and material sample engaged therein.
Figure 2:
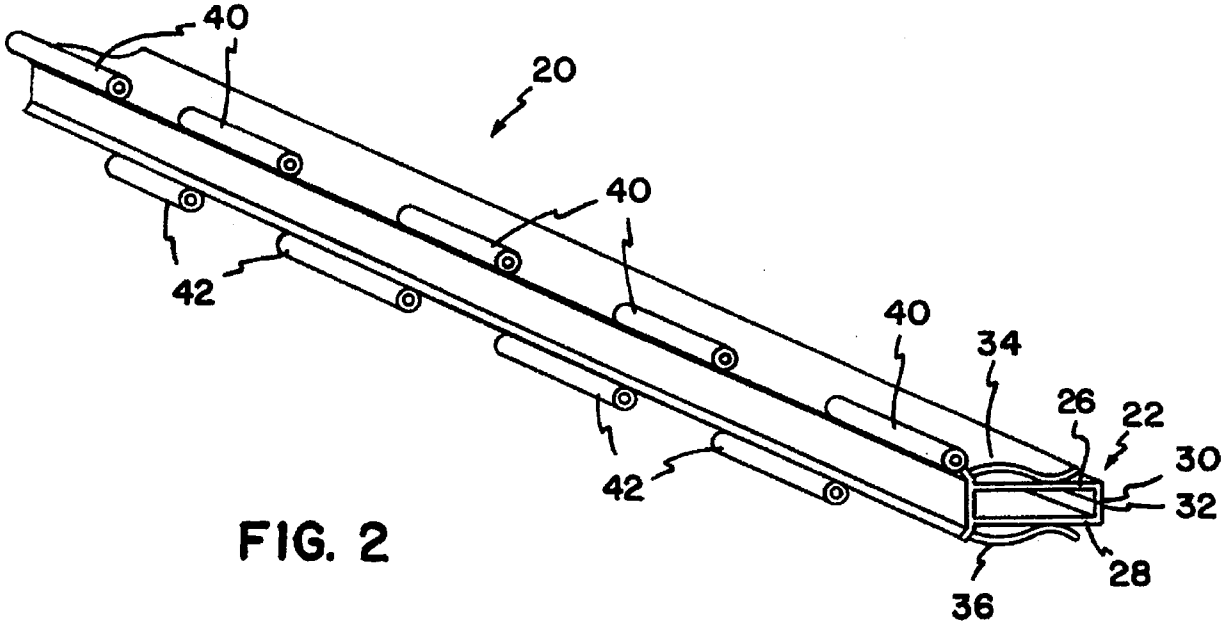
FIG. 2 is a perspective view of a hinge clip according to the principles of the present invention.

Referring to FIGS. 2–3, a hinge clip in accordance with this invention is illustrated generally at 20. Hinge clip 20 contains clamp 22 designed to firmly hold board 24 in place along the length thereof. Board 24 is intended to form one page of a display book. Board 24 is partially shown in FIG. 3 and is preferably made of a material capable of supporting several layers of display samples which may vary in weight from very light to fairly heavy. One skilled in the art would readily appreciate how the selection of the board thickness and durability is dependent upon its intended use. Exemplary types of boards which can be used in practicing this invention include laminated paper (e.g. 18 point thick), cardboard and the like.

Clamp 22 has a first arm 26 and a second arm 28 which are biased to a closed position as shown in FIG. 2. Clamp 22 functions as a spring by exerting a force on board 24 when inserted between first arm 26 and second arm 28 to firmly hold it in place as shown in FIG. 3. Preferably, the board is sufficiently secured to the clamp to prevent it from sliding out during the normal usage of a display book prepared therefrom. Both arms have gripping surfaces 30 and 32 which contact board 24. Gripping surfaces 30 and 32 can be formed integral with first arm 26 and second arm 28, respectively, as shown in FIGS. 2-3. Alternatively, they can be added to the arms after the clamp is formed to provide increased pressure on the board or to provide increased friction to prevent the board from slipping. In any event, the surfaces of the arms contacting the board are referred to as the gripping surfaces.

Hinge clip 20 includes clips 34 and 36 positioned along the outside surfaces of first arm 26 and second arm 28, respectively. FIG. 3 shows clip 20 holding display sample 38 in place along the outside surface of first arm 26. The clips provide a sufficient amount of force against display samples inserted therein to hold them in place under normal conditions of using a display book while allowing them to be conveniently removed by hand if desired.

Figure 4:
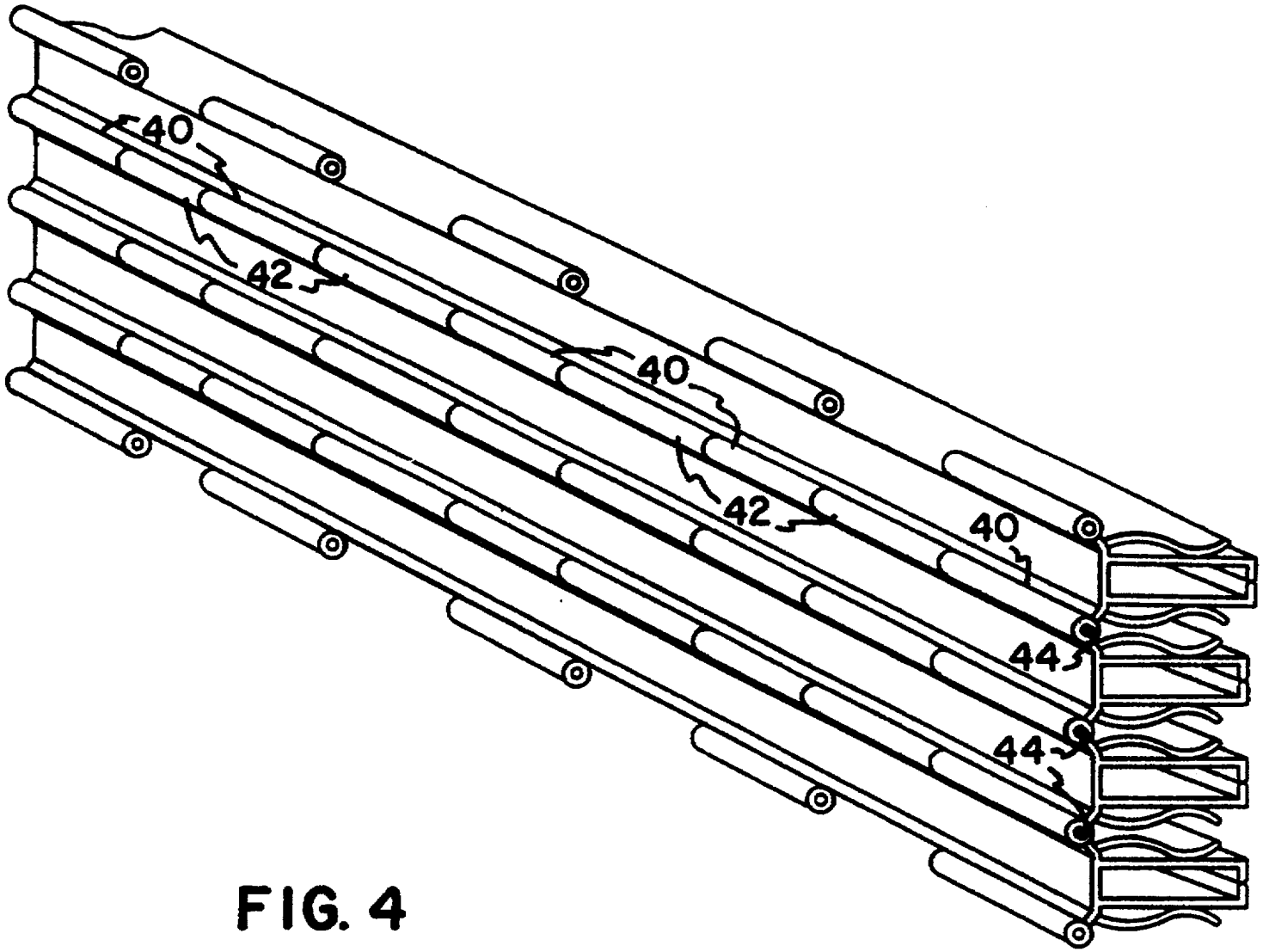
FIG. 4 is a perspective view of several hingedly connected hinge clips.

Hinge clip 20 additionally includes dual rows of axially aligned staggered connecting tubes capable of interlocking with axially aligned staggered connecting tubes from another hinge clip. The dual rows of axially aligned staggered connecting tubes have outside connecting tubes 40 and inside connecting tubes 42 along the backside of hinge clip 20 for hingedly connecting two or more hinge clips to form a display book. The dual rows of axially aligned staggered connecting tubes along the backside of the hinge clip can be assembled to provide the binder of a display book. Several hinge clips 20 can be connected together wherein outside connecting tubes from one hinge clip are provided on the same axis with inside connecting tubes of another hinge clip as shown in FIG. 4. Axis pin 44 extends through the axially aligned tubes to provide an axis around which the hinge clips can rotate. Axis pin 44 additionally functions to keep the hinge clips axially aligned and connected. Alternative designs for hingedly connecting the hinge clips can be used without departing from the scope of the invention. It is desirable that the hinge connection be capable of structurally holding the display book together. For example, the hinge clips could be connected via pliable hinges if they are structurally sufficient to provide a working display book.

Hinge clip 20 is a one piece plastic, extruded article made by extruding polyvinyl chloride through a die. Preferably, the hinge clip according to the invention is formed by extruding a plastic or polymer composition through a die as one piece. Exemplary plastics which can be used include those plastics capable of being extruded and providing sufficient structural support. Desired hinge clips can be prepared by combining a clamp and a clip after both have been prepared individually from, for example, plastic and/or metal. The clamp and clip can be attached by adhesive.

As discussed above the hinge clip is preferably made by extruding plastic, such as polyvinyl chloride, through a die. The initial extruded product will have dual rows of continuous tubes on the backside of the clamp. In order to form the dual rows of axially aligned staggered connecting tubes, certain portions of the continuous tubes can be cut away.

Figure 5:
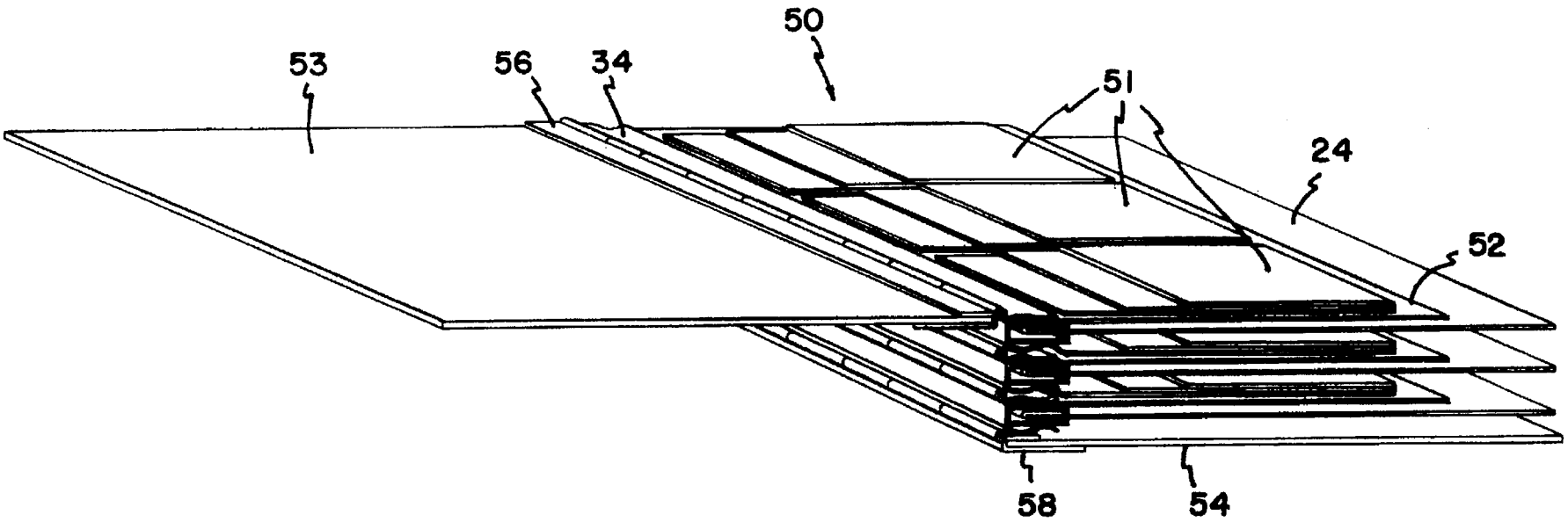
FIG. 5 is a perspective view of a display book having pages and material samples engaged therein according to the principles of the present invention.

FIG. 5 shows a fully assembled display book 50 wherein several display samples 51 attached to display holder 52 are arranged therein. Display book 50 has covers 53 and 54 which are attached using special cover hinges 56 and 58, respectively. Similar to the hinge clips, cover hinges 56 and 58 contain axially aligned staggered connecting tubes which can be axially aligned with either the outside connecting tubes or inside connecting tubes of the hinge clips. Axis pins can be used to hold the tubes in alignment and allow the covers to rotate similar to conventional book covers. The covers are held to the cover hinges by a friction fit.

Advantageously, display samples 51 are attached to display holders 52 in such a way that the loose ends of the samples are near the hinge clips. This arrangement allow the pages of the display book to be turned without having the display samples bunch up near the hinge clips. If desired, of course, the display samples can be One or more of the embodiments described above perform all of the functions of the prior art devices, but have the advantage of fewer parts, avoiding adhesives, allowing quicker assembly, and providing a leaner and more efficient design. Other advantages may also be evident to those of skill in the art.

While the invention has been described in conjunction with a specific embodiment thereof, it is evident that different alternatives, modifications, variations, and uses will be apparent to those skilled in the art in view of the foregoing description. Accordingly, the invention is not limited to these embodiments or the use of elements having specific configurations and shapes as presented herein.

What is claimed is:

1. A hinge clip comprising:

(a) a clamp having a first arm and a second arm, each arm having an inside surface and an outside surface;

(b) a clip provided on the outside surface of the first arm of said clamp for releasably holding at least one sample against the outside surface of the first arm of said clamp; and (c) a binder provided on said clamp for hingedly connecting said hinge clip wherein said clamp and said clip are positioned such that a board extended from said clamp extends in the same direction as a sample card inserted in said clip.

2. The hinge clip according to claim 1, wherein the first and second arms of said clamp each have a gripping surface for securing a board therein.

3. The hinge clip according to claim 1 wherein said clip is a first clip and, further comprising a second clip positioned along a length of the outside surface of the second arm of said clamp.

4. The hinge clip according to claim 1, wherein said binder comprises dual rows of axially aligned staggered connecting tubes located on a backside of said elongated clamp.

5. The hinge clip according to claim 1, wherein the hinge clip is formed entirely from a continuous extruded plastic material.

6. A display book for holding display samples comprising at least two interconnected hinge clips, wherein each hinge clip comprises:

(a) a clamp having a first arm and a second arm, each arm having an inside and an outside surface;

(b) a clip provided on the outside surface of the first arm of said clamp for releasably holding at least one sample against the outside surface of the first arm of said clamp; and (c) a binder provided on said clamp for hingedly connecting said hinge clip wherein said clamp and said clip are positioned such that a board extended from said clamp extends in the same direction as a sample card inserted in said clip.

7. The display book for displaying samples according to claim 6, wherein each of said clip on said hinge clip is a first clip and at least one of said each hinge clip further comprises a second clip positioned along a length of the outside surface of the second arm of said clamp.

8. The display book for displaying samples according to claim 7, further comprising a page secured between the inside surfaces of the first and second arms of said elongated clamp.

9. The display book for displaying samples according to claim 8, further comprising samples releasably attached between said first clip and the outside surface of the first arm of said clamp.

10. The display book according to claim 9, wherein said binder comprises dual rows of axially aligned staggered connecting tubes located on a backside of said clamp, and an axis pin hingedly connecting said tube members.

11. The display book according to claim 6, wherein said interconnected hinge clips include a top hinge clip and a bottom hinge clip, further comprising a first cover hingedly connected to the top hinge clip and a second cover hingedly connected to the bottom hinge clip.

12. A method for displaying samples in a book, said method comprising providing a display book according to claim 6, and inserting at least one board in clamp, and inserting at least one material sample between said clip and the outside surface of the first arm of said hinge.

* * * * *